US009409391B2

(12) United States Patent
Kim et al.

(10) Patent No.: US 9,409,391 B2
(45) Date of Patent: Aug. 9, 2016

(54) METHODS OF DRIVING HYBRID INKJET PRINTING APPARATUS INCLUDING RESONATING INK IN A NOZZLE

(75) Inventors: Joong-hyuk Kim, Seoul (KR); Young-ki Hong, Anyang-si (KR); Jae-woo Chung, Seoul (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 499 days.

(21) Appl. No.: 13/568,604

(22) Filed: Aug. 7, 2012

(65) Prior Publication Data

US 2013/0176354 A1 Jul. 11, 2013

(30) Foreign Application Priority Data

Jan. 11, 2012 (KR) ..... 10-2012-0003456

(51) Int. Cl.

| | |
|---|---|
| ***B41J 29/38*** | (2006.01) |
| ***B41J 2/045*** | (2006.01) |
| ***B41J 2/06*** | (2006.01) |
| ***B41J 2/14*** | (2006.01) |

(52) U.S. Cl.

CPC ..... *B41J 2/04581* (2013.01); *B41J 2/04588* (2013.01); *B41J 2/06* (2013.01); *B41J 2/14233* (2013.01)

(58) Field of Classification Search

CPC ..... B41J 2/04581; B41J 2/06; B41J 2/14233; B41J 2/04588

USPC ..... 347/10, 48, 47

See application file for complete search history.

(56) References Cited

U.S. PATENT DOCUMENTS

| | | | | |
|---|---|---|---|---|
| 5,023,625 | A * | 6/1991 | Bares et al. | 347/48 |
| 5,477,249 | A * | 12/1995 | Hotomi | 347/48 |
| 6,092,886 | A | 7/2000 | Hosono | |
| 6,106,092 | A * | 8/2000 | Norigoe et al. | 347/11 |
| 6,629,741 | B1 | 10/2003 | Okuda et al. | |
| 6,799,821 | B1 * | 10/2004 | Okuda | 347/10 |
| 7,314,185 | B2 | 1/2008 | Nishi et al. | |
| 7,905,578 | B2 * | 3/2011 | Nishi | B41J 2/14314 347/47 |
| 8,342,623 | B2 * | 1/2013 | Hong et al. | 347/10 |

(Continued)

FOREIGN PATENT DOCUMENTS

| | | |
|---|---|---|
| JP | 2004-202893 A | 7/2004 |
| JP | 2009-073074 A | 4/2009 |
| JP | 2010-006048 A | 1/2010 |

OTHER PUBLICATIONS

"On-demand electrohydrodynamic jetting with meniscus control by a piezoelectric actuator for ultra-fine patterns" Young-Jae Kim et al 2009 J. Micromech. Microeng. 19 107001 doi:10.1088/0960-1317/19/10/107001.*

*Primary Examiner* — Stephen Meier
*Assistant Examiner* — John P Zimmermann
(74) *Attorney, Agent, or Firm* — Harness, Dickey & Pierce, P.L.C.

(57) ABSTRACT

A method of driving a hybrid inkjet printing apparatus includes applying an electrostatic voltage to ink contained in a nozzle, applying a waveform voltage to ink contained in the nozzle, the waveform voltage being applied by a piezoelectric driving device, and applying an ejection voltage so as to eject the ink.

16 Claims, 7 Drawing Sheets

(56) References Cited

U.S. PATENT DOCUMENTS 8,807,678 B2 * 8/2014 Chung et al. ..... 347/10
2008/0122887 A1 * 5/2008 Ueno et al. ..... 347/10
2010/0194800 A1 * 8/2010 Hong ..... B41J 2/14233 347/9
2010/0265289 A1 * 10/2010 Chung ..... B41J 2/04551 347/10
2011/0134175 A1 * 6/2011 Hong ..... B41J 2/04506 347/10
2013/0063529 A1 * 3/2013 Hong ..... B41J 2/06 347/71

* cited by examiner

METHODS OF DRIVING HYBRID INKJET PRINTING APPARATUS INCLUDING RESONATING INK IN A NOZZLE

CROSS-REFERENCE TO RELATED APPLICATIONS

This application claims the benefit of Korean Patent Application No. 10-2012-0003456, filed on Jan. 11, 2012, in the Korean Intellectual Property Office, the disclosure of which is incorporated herein in its entirety by reference.

BACKGROUND

1. Field

At least one example embodiment relates to methods of driving a hybrid inkjet printing apparatus that ejects relatively minute droplets (for example, droplets having a volume of less than about 50 femtoliters), the methods including a piezoelectric method and an electrostatic method.

2. Description of the Related Art

Inkjet printing apparatuses print a desired (or alternatively, predetermined) color image on a surface of a printing sheet by ejecting minute droplets of printing ink onto a desired area of the printing sheet using an inkjet head. Recently, inkjet printing apparatuses have been used in various fields such as flat display fields, for example, liquid crystal displays (LCDs) and organic light emitting devices (OLEDs); flexible display fields, for example, E-paper; printed electronics fields, for example, metal wirings, organic thin film transistors (OTFTs); and the like. When inkjet printing apparatuses are used in the fields of displays or printed electronics, one important technical objective for process technologies is high-resolution and precise printing.

Inkjet printing apparatuses use various inkjet ejecting methods, for example, a piezoelectric method or an electrostatic method. The piezoelectric method is a method of ejecting ink by deforming a piezoelectric element. The electrostatic method is a method of ejecting ink using an electrostatic force. The electrostatic method ejects ink using electrostatic induction, which includes accumulating charged pigments using an electrostatic force and then ejecting ink droplets.

Since a piezoelectric-type printing inkjet printing apparatus ejects ink by using a drop on demand (DOD) method, printing operations of the piezoelectric-type printing inkjet printing apparatus are easily controlled. Further, piezoelectric-type printing inkjet printing apparatuses use a simple driving method, and ejection energy is generated by mechanically deforming a piezoelectric element. Thus, a piezoelectric-type printing inkjet printing apparatus may use any ink. However, the piezoelectric-type printing inkjet printing apparatus has difficulty ejecting ink in minute droplets of several picoliters or less. The piezoelectric-type printing inkjet apparatus also has difficulty with applications requiring relatively high-precision printing.

An electrostatic-type inkjet printing apparatus has been used to address some of the above issues. Electrostatic-type printing apparatuses have a simple driving method, and are capable of ejecting minute ink droplets with a relative precision. However, an electrostatic-induction inkjet printing apparatus of the electrostatic-type inkjet printing apparatus has difficulty in forming separate inkjet paths. Thus, it is difficult to eject ink using a DOD method from a plurality of nozzles. In addition, electrostatic printing methods are limited in ejection speed of ink as well as the kinds of ink used because electrostatic methods require charged pigments with high densities.

With regard to inkjet printing apparatuses in general, the size of ejected ink droplets is proportional to a diameter of a nozzle. Thus, in order to eject minute ink droplets, the size of a nozzle needs to be reduced. However, when the size of the nozzle is reduced, it is difficult to obtain precise nozzles and the nozzle is more likely to clog, thereby reducing reliability.

SUMMARY

At least one example embodiment provides methods of driving a hybrid inkjet printing apparatus that ejects minute droplets using a piezoelectric method and an electrostatic method together.

Additional aspects will be set forth in part in the description which follows and, in part, will be apparent from the description, or may be learned by practice of example embodiments.

According to an example embodiment, a method of driving a hybrid inkjet printing apparatus includes applying an electrostatic voltage to ink contained in a nozzle; applying a waveform voltage to ink contained in the nozzle, the waveform voltage being applied by a piezoelectric driving device; and applying an ejection voltage so as to eject the ink.

In at least one example embodiment, the applying of the electrostatic voltage may be maintained when the ink resonates and the ink is ejected.

In at least one example embodiment, the applying of the waveform voltage may include applying a voltage such that the ink oscillates in the nozzle.

In at least one example embodiment, the applying of the waveform voltage may applying the waveform voltage for a duration corresponding to a resonance period of a meniscus of the ink.

In at least one example embodiment, the method may further include measuring the resonance period of the meniscus using the waveform voltage.

In at least one example embodiment, the measuring of the resonance period of the meniscus may include applying the waveform voltage to the piezoelectric driving device such that ink is not ejected; measuring a displacement of the meniscus; and determining a time between two peaks of the displacement as the resonance period.

In at least one example embodiment, the applying of the ejection voltage may include applying the ejection voltage when the meniscus of the ink contained in the nozzle is moved in a direction in which the ink contained in the nozzle is ejected.

In at least one example embodiment, the ejection voltage may be a pulse voltage having an absolute value greater than an absolute value of the waveform voltage.

In at least one example embodiment, ink droplets having a smaller size than a size of the nozzle may be ejected.

In at least one example embodiment, the applying of the electrostatic voltage may include applying the electrostatic voltage for a desired period of time after the ejection voltage is applied.

According to another example embodiment, a method of driving a hybrid inkjet printing apparatus includes applying a waveform voltage, the waveform voltage being applied by an electrostatic device; applying an ejection voltage so as to eject the ink contained in the nozzle; and applying an electrostatic voltage to the electrostatic driving device during the applying of the ejection voltage.

In at least one example embodiment, the waveform voltage and the ejection voltage having a same polarity may be applied.

In at least one example embodiment, the applying of the waveform voltage may include applying the waveform voltage such that the ink oscillates in the nozzle.

In at least one example embodiment, the applying of the waveform voltage comprises applying the waveform voltage for a duration corresponding a resonance period of a meniscus of the ink.

In at least one example embodiment, the method further comprises measuring the resonance period of the meniscus using the waveform voltage.

In at least one example embodiment, the measuring of the resonance period of the meniscus comprises: applying the waveform voltage such that ink is not ejected; measuring a displacement of the meniscus; and determining a time between two peaks of the displacement as the resonance period.

In at least one example embodiment, the applying of the ejection voltage comprises applying the ejection voltage if the meniscus of the ink contained in the nozzle is moved in a direction in which the ink contained in the nozzle is ejected.

In at least one example embodiment, the ejecting of the ink comprises ejecting ink droplets having a smaller size than a size of the nozzle.

In at least one example embodiment, the applying of the electrostatic voltage comprises applying the electrostatic voltage for a desired period of time after the ejection voltage is applied.

In a driving method according to at least one example embodiment, since an ejection voltage is applied when a meniscus of ink contained in a nozzle resonates, the ejection voltage is low and minute droplets may be ejected. Thus, minute droplets having a volume of 50 femtoliters or less may also be ejected through a nozzle having a relatively great diameter, for example, a diameter of several μm to several tens of μm, without reducing the size of the nozzle.

In addition, even if a nozzle having a relatively great diameter may be used, minute droplets may be ejected and thus the nozzle is not likely to clog, thereby increasing reliability of a printing apparatus.

Since an electrostatic force acts on minute droplets when the minute droplets are ejected, the minute droplets having a volume of 50 femtoliters or less may proceed to have good straightness without dragging and thus, precise printing may be performed.

BRIEF DESCRIPTION OF THE DRAWINGS

These and/or other aspects will become apparent and more readily appreciated from the following description of example embodiments, taken in conjunction with the accompanying drawings in which.

DETAILED DESCRIPTION OF EXAMPLE EMBODIMENTS

Figure 1:
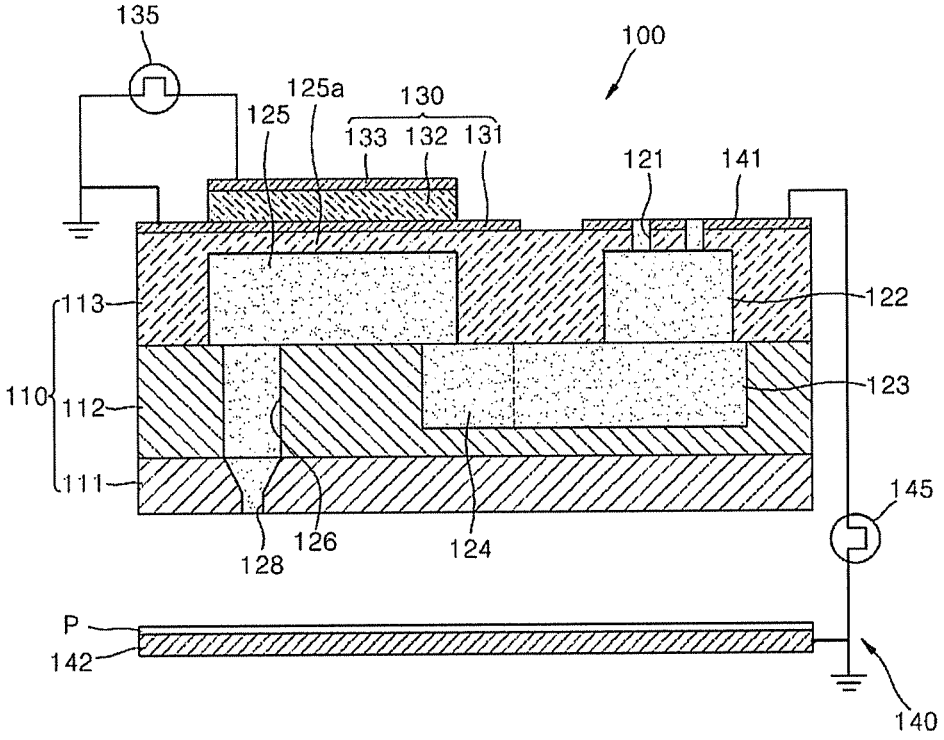
FIG. 1 is a cross-sectional view of a hybrid inkjet printing apparatus according to an example embodiment.

Example embodiments will be understood more readily by reference to the following detailed description and the accompanying drawings. Example embodiments may, however, be embodied in many different forms and should not be construed as being limited to those set forth herein. Rather, these example embodiments are provided so that this disclosure will be thorough and complete. In at least some example embodiments, well-known device structures and well-known technologies will not be specifically described in order to avoid ambiguous interpretation.

It will be understood that when an element is referred to as being "connected to" or "coupled to" another element, it can be directly on, connected or coupled to the other element or intervening elements may be present. In contrast, when an element is referred to as being "directly connected to" or "directly coupled to" another element, there are no intervening elements present. Like numbers refer to like elements throughout. As used herein, the term "and/or" includes any and all combinations of one or more of the associated listed items.

It will be understood that, although the terms first, second, third, etc., may be used herein to describe various elements, components and/or sections, these elements, components and/or sections should not be limited by these terms. These terms are only used to distinguish one element, component or section from another element, component or section. Thus, a first element, component or section discussed below could be termed a second element, component or section without departing from the teachings of example embodiments.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises," "comprising," "includes," and/or "including" when used in this specification, specify the presence of stated components, steps, operations, and/or elements, but do not preclude the presence or addition of one or more other components, steps, operations, elements, and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Spatially relative terms, such as "below", "beneath", "lower", "above", "upper", and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

FIG. 1 is a cross-sectional view of a hybrid inkjet printing apparatus 100 according to an example embodiment.

Referring to FIG. 1, the hybrid inkjet printing apparatus 100 includes a flow channel plate 110 on which an ink channel is formed, a piezoelectric actuator 130 providing a driving force for ejecting ink, and an electrostatic force applier 140. Hereinafter, the piezoelectric actuator 130 and an electrostatic force applier 140 will also be referred to as a piezoelectric driving device and an electrostatic driving device, respectively.

The flow channel plate 110 includes an inkjet inlet 121 to which ink is introduced, a plurality of pressure chambers 125 containing the introduced ink, and a plurality of nozzles 128 for ejecting ink droplets. The inkjet inlet 121 is formed in an upper surface of the flow channel plate 110 and is connected to an ink tank (not shown). Ink provided from the ink tank is introduced into the flow channel plate 110 through the inkjet inlet 121. Manifolds 122 and 123 and a restrictor 124, which connect the inkjet inlet 121 and the pressure chambers 125 to each other, may be formed in the flow channel plate 110.

The nozzles 128 are respectively connected to the pressure chambers 125 and eject ink in the form of droplets. The plurality of the nozzles 128 may be formed on a lower surface of the flow channel plate 110 and may be disposed in one row or two rows. A plurality of dampers 126 for connecting the pressure chambers 125 and the nozzles 128 to each other may be formed in the flow channel plate 110.

The flow channel plate 110 may be formed of a material having good micromachining properties, for example, silicon. The flow channel plate 110 may be formed by adhering three substrates, that is, a first substrate 111, a second substrate 112, and a third substrate 113, which are sequentially stacked, by silicon direct bonding (SDB).

The inkjet inlet 121 may be vertically formed through an uppermost substrate, that is, the third substrate 113. The pressure chambers 125 may be formed to a desired (or alternatively, predetermined) depth from a lower surface of the third substrate 113. The nozzles 128 may be vertically formed through a lowermost substrate, that is, the first substrate 111. The manifolds 122 and 123 may be formed in the third substrate 113 and the second substrate 112 that is an intermediate substrate. The dampers 126 may be vertically formed through the second substrate 112.

Thus far, the case where the flow channel plate 110 includes the first, second, and third substrates 111, 112, and 113 has been described but is just an example and example embodiments are not limited thereto. Thus, the flow channel plate 110 may include a single substrate, two substrates, or four or more substrates. Ink paths formed in the flow channel plate 110 may be variously arranged and may be changed to have various structures.

The piezoelectric actuator 130 provides a driving force, that is, a pressure change for ejecting ink to the pressure chambers 125 and is formed on the upper surface of the flow channel plate 110 to correspond to each of the pressure chambers 125. The piezoelectric actuator 130 may include a lower electrode 131, a piezoelectric film 132, and an upper electrode 133, which are sequentially stacked on the upper surface of the flow channel plate 110.

The lower electrode 131 serves as a common electrode. The upper electrode 133 serves a driving electrode for applying a voltage to the piezoelectric film 132. A first power source 135 is connected to the lower electrode 131 and the upper electrode 133. The first power source 135 includes a waveform voltage generator and a pulse voltage generator. The piezoelectric film 132 is deformed by a voltage applied from the first power source 135 to deform an upper wall 125*a* of the pressure chamber 125. The upper wall 125*a* serves as a vibration plate that is driven by the piezoelectric actuator 130 and is deformed to generate a pressure wave in the pressure chambers 125. The piezoelectric film 132 may be formed of a desired (or alternatively, predetermined) piezoelectric material, for example, lead zirconate titanate (PZT).

The electrostatic force applier 140 applies an electrostatic force to the ink contained in the nozzles 128 and includes a first electrostatic electrode 141 and a second electrostatic electrode 142, which face each other, and a second power source 145 for applying a voltage between the first electrostatic electrode 141 and the second electrostatic electrode 142. The second power source 145 includes a high-voltage generator and a pulse generator. The electrostatic force applier 140 may accelerate ejected minute ink droplets so as to reduce (or alternatively, prevent) the minute ink droplets from dragging.

The first electrostatic electrode 141 is disposed on the flow channel plate 110. For example, the first electrostatic electrode 141 may be formed on the upper surface of the flow channel plate 110, that is, the upper surface of the third substrate 113. In this case, the first electrostatic electrode 141 may be disposed on an area in which the inkjet inlet 121 is formed so as to be spaced apart from the lower electrode 131 of the piezoelectric actuator 130. The second electrostatic electrode 142 may be disposed so as to be spaced apart from the lower surface of the flow channel plate 110. In addition, a printing medium P on which the ink droplets ejected from the nozzles 128 of the flow channel plate 110 are printed may be positioned on the second electrostatic electrode 142.

Since the hybrid inkjet printing apparatus 100 having the above-described structure uses both a piezoelectric method and an electrostatic method as an inkjet ejecting method, the hybrid inkjet printing apparatus 100 may have the advantages of both the piezoelectric method and the electrostatic method. That is, according to at least one example embodiment, since the hybrid inkjet printing apparatus 100 may eject ink by using a drop on demand (DOD) method, it is easy to control a printing operation and to realize minute droplets, and to eject ink droplets straight. Thus, the hybrid inkjet printing apparatus 100 may be advantageously used in precision printing.

According to an example embodiment, the resonance characteristics of a meniscus of ink contained in a nozzle may be utilized.

Figure 2:
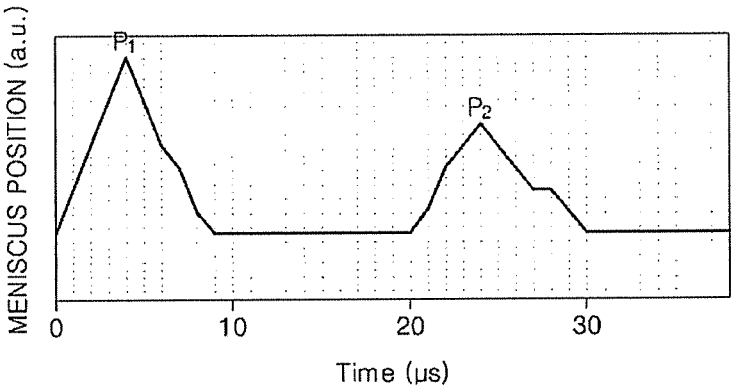
FIG. 2 is a graph showing a displacement of a meniscus for measuring a resonance period of a meniscus of ink contained in a nozzle.

FIG. 2 is a graph showing a displacement of a meniscus for measuring a resonance period of a meniscus of ink contained in a nozzle. In order to obtain the resonance period of the meniscus of ink, the resonance period may be calculated by using a volume of ink channels and physical properties of ink. Alternatively, the resonance period may be measured from a displacement of the meniscus of ink at a nozzle while a desired (or alternatively, predetermined) pulse voltage is applied to a piezoelectric actuator such that the ink contained in the nozzle flows and the ink droplets are not ejected from the nozzle. In other words, the resonance period may be determined as the ink oscillates in the nozzle. The resonance period of the meniscus may be referred to as a resonance period of ink contained in the nozzle.

Referring to FIG. 2, a time between two peaks P1 and P2 that are measured when the meniscus is in a convex state corresponds to a resonance period and is measured as about 20 μs. The resonance period of the meniscus may vary according to the size of nozzle and the physical properties of ink.

Figure 3:
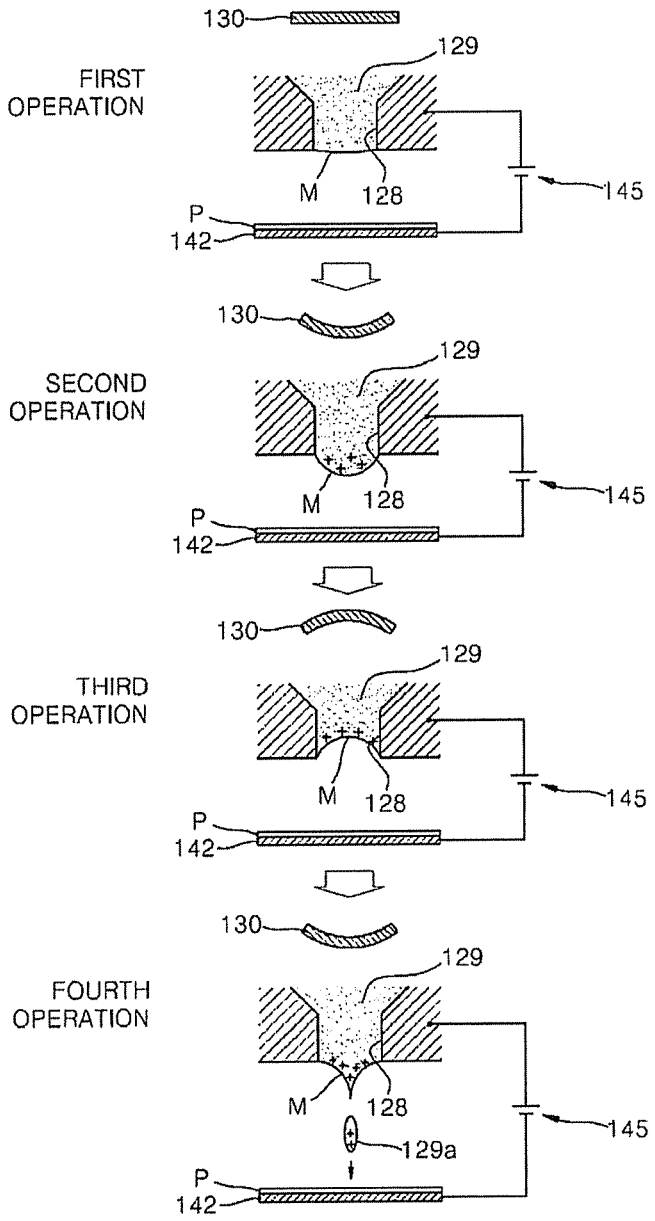
FIG. 3 is a set of diagrams for explaining a method of driving a hybrid inkjet printing apparatus, according to an example embodiment.
Figure 4:
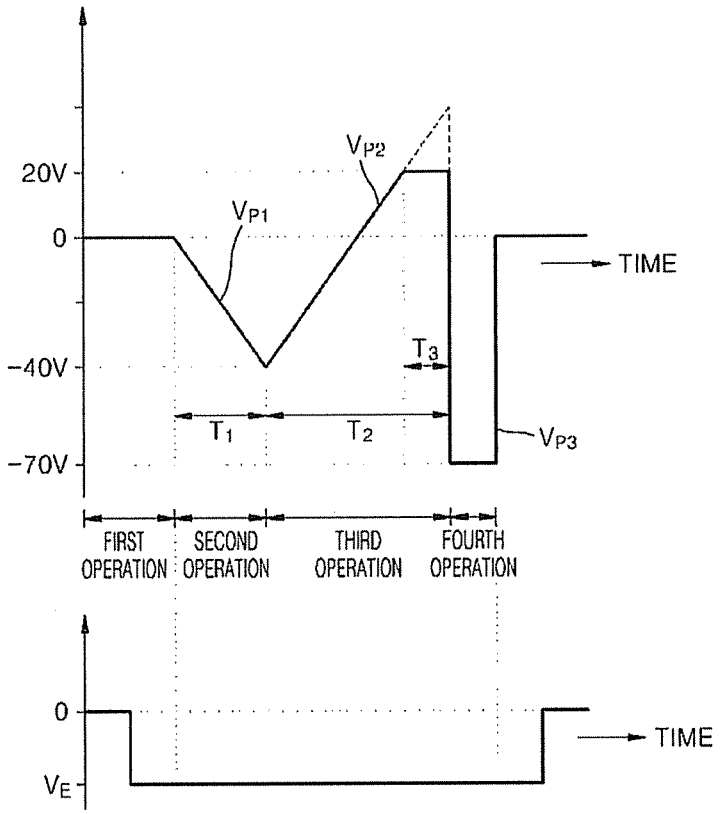
FIG. 4 is a timing diagram for explaining a method of driving a hybrid inkjet printing apparatus, according to an example embodiment.

FIG. 3 is diagrams for explaining a method of driving the hybrid inkjet printing apparatus 100, according to an example embodiment. FIG. 4 is a timing diagram for explaining a method of driving the hybrid inkjet printing apparatus 100, according to an example embodiment.

Referring to FIGS. 3 and 4, in a first operation, a voltage is not applied to the piezoelectric actuator 130 and a desired (or alternatively, predetermined) electrostatic voltage VE is applied between the first electrostatic electrode 141 and the second electrostatic electrode 142 from the second power source 145. For example, a voltage of −2 kV may be applied and thus positive charges and particles exhibiting positive charges may be moved to a meniscus M from ink 129 toward the second electrostatic electrode 142. In this case, since an electrostatic force that acts on the ink 129 contained in the nozzle 128 is relatively low, the meniscus M of the ink 129 is in a stationary state.

In a second operation, a first waveform voltage VP1 is applied to the piezoelectric actuator 130 for a time T1, which is 1/4 the resonance period of the meniscus M. In this case, a state in which an electrostatic voltage VE is applied between the first electrostatic electrode 141 and the second electrostatic electrode 142 is maintained.

The first waveform voltage VP1 is a voltage for deforming the piezoelectric actuator 130 in a first direction in which the volume of the pressure chamber 125 reduces. The first waveform voltage VP1 slowly increases from 0 V and reaches about −40 V. In this case, the meniscus M is convex from the nozzle 128 toward the second electrostatic electrode 142.

In a third operation, a second waveform voltage VP2 is applied to the piezoelectric actuator 130 for a time T2, which is 1/2 the resonance period of the meniscus M. In this case, a state in which the electrostatic voltage VE is applied between the first electrostatic electrode 141 and the second electrostatic electrode 142 is maintained.

The second waveform voltage VP2 is a voltage for deforming the piezoelectric actuator 130 in a second direction in which the volume of the pressure chamber 125 increases. The second waveform voltage VP2 may gradually increase from, for example, −40 V to about 20 V. When the second waveform voltage VP2 reaches 20V, then the second waveform voltage VP2 may be maintained for a desired (or alternatively, predetermined) period of time T3. In this case, the meniscus M is concave with respect to the nozzle 128.

A maximum voltage of the second waveform voltage VP2 is smaller than a maximum voltage of the first waveform voltage VP1 and the maximum voltage of the second waveform voltage VP2 is maintained for a desired (or alternatively, predetermined) period of time T3 in order to easily perform a next ejecting operation of droplets.

In a fourth operation, a third voltage VP3 is applied to the piezoelectric actuator 130 in a direction in which the volume of the pressure chamber 125 decreases. The third voltage VP3 may be a pulse voltage, for example, −70 V. An absolute value of the third voltage VP3 is greater than an absolute value of the first waveform voltage VP1 and thus ink is ejected out of the nozzle 128 in the form of droplet 129*a*.

In general, an electrostatic force FE is proportional to a charge quantity q and an electric field intensity E, as shown in Equation 1 below. In addition, as shown in Equation 2 below, the charge quantity q is also proportional to the electric field intensity E. Thus, as shown in Equation 3 below, the electrostatic force FE is proportional to the square of the electric field intensity E. As shown in Equation 4 below, the electric field intensity E is proportional to the applied electrostatic voltage $V_E$ but is inversely proportional to a radius of curvature $r_m$ of the meniscus M. Thus, as shown in Equation 5 below, the electrostatic force $F_E$ that acts on the ink 129 that sharply protrudes at an end of the nozzle 128 is inversely proportional to the square of the radius of curvature $r_m$ of the meniscus M of the portion.

$$F_E \propto qE \tag{1}$$

$$q \propto E \tag{2}$$

$$F_E \propto E^2 \tag{3}$$

$$E \propto \frac{V_E}{r_m} \tag{4}$$

$$F_E \propto \left(\frac{V_E}{r_m}\right)^2 \tag{5}$$

A resonance waveform voltage (i.e., a first waveform voltage and a second waveform voltage) is applied such that ink contained in the nozzle 128 resonates and thus the droplet 129*a* is ejected by a small force, that is, a small piezoelectric voltage. Since the size of the ejected droplet 129*a* is proportional to a piezoelectric voltage, the small droplet 129*a* may be ejected by applying a low piezoelectric voltage. In this case, since the ink 129 is ejected to sharply protrude at a central portion of the nozzle 128, the droplet 129*a* having a relatively small size compared with the size of the nozzle 128 may be ejected. Thus, when the droplet 129*a* is ejected based on resonance, the droplet 129*a* has a jet shape.

The ejected droplet 129*a* is accelerated in a direction toward the second electrostatic electrode 142 by the electrostatic force FE so as to be printed on the printing medium P. Since the ejected droplet 129*a* having a jet shape has a small radius of curvature compared with a spherical droplet having the same value as the ejected droplet 129*a*, a relatively high electrostatic driving force acts on the ejected droplet 129*a*. Even if the droplet 129*a* having a volume of 50 femtoliters or less is ejected, the droplet 129*a* may be less likely to scatter (or alternatively, be prevented from being scattered) as a result of the electrostatic driving force. Thus, relatively minute droplets may be ejected onto the printing medium P with high precision.

As shown in FIG. 3, when the third voltage VP3 applied to the piezoelectric actuator 130 is removed, the piezoelectric actuator 130 returns to an original state and a pressure in the pressure chamber 125 returns to an original state, and the meniscus M having a convex shape returns to an original state. In this case, a state where the electrostatic voltage VE is applied between the first electrostatic electrode 141 and the second electrostatic electrode 142 may be maintained. Thus, the droplet 129*a* having positive charges may precisely reach the printing medium P by an electrostatic force.

FIG. 4 shows a case where a piezoelectric voltage for resonating ink has a linear waveform but example embodiments are not limited to this. For example, the piezoelectric voltage may have a curve shape like an alternating current (AC) voltage.

As described above, in a driving method according to an example embodiment, ink droplets having a relatively small size compared with the size of a nozzle may be ejected. That is, minute droplets having a volume of 50 femtoliters or less may also be ejected through a nozzle having a relatively great diameter, for example, a diameter of several μm to several tens of μm without reducing the size of a nozzle. In addition, even if a nozzle having a relatively great diameter is used, minute droplets may be ejected and thus the nozzle is not likely to clog, thereby increasing reliability of a printing apparatus. Further, minute droplets may reach a desired position of the printing medium P using an electrostatic force that acts on the minute droplets.

Figure 5:
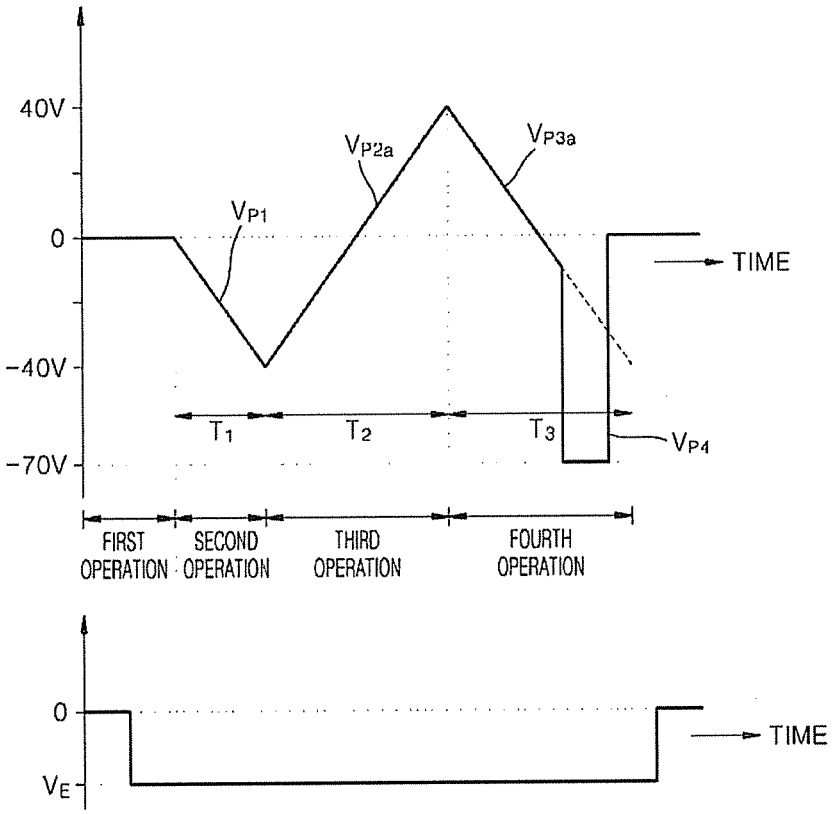
FIG. 5 is a timing diagram for explaining a method of driving a hybrid inkjet printing apparatus, according to another example embodiment.

FIG. 5 is a timing diagram for explaining a method of driving the hybrid inkjet printing apparatus 100, according to another example embodiment. Details of substantially the same operations as in FIGS. 3 and 4 will not be repeated.

Referring to FIG. 5, a first operation and a second operation are the same as in FIGS. 3 and 4. In a third operation, a second waveform voltage VP2*a* is applied to the piezoelectric actuator 130 for a time T2, which is 1/2 the resonance period of the meniscus M. In this case, a state in which the electrostatic voltage VE is applied between the first electrostatic electrode 141 and the second electrostatic electrode 142 is maintained.

The second waveform voltage VP2*a* is a voltage for deforming the piezoelectric actuator 130 in a second direction in which the volume of the pressure chamber 125 increases. The second waveform voltage VP2*a* may gradually increase from, for example, −40 V to about 40 V. In this case, the meniscus M is concave with respect to the nozzle 128.

In a fourth operation, a third waveform voltage VP3*a* is applied to the piezoelectric actuator 130 in a direction in which the volume of the pressure chamber 125 decreases. The third waveform voltage VP3*a* may gradually reduce from, for example, 40 V to about −40 V. In this case, the meniscus M is gradually deformed to be convex from the nozzle 128 toward the second electrostatic electrode 142. The fourth operation is performed during a time T3, which is 3/4 to 5/4 the resonance period of the meniscus M. In the fourth operation, since the meniscus M is moved in a direction in which ink is ejected, a driving voltage for ejecting ink droplets reduces.

For the time T3 of the fourth operation, a fourth voltage VP4 for deforming the pressure chamber 125 in a direction in which the volume of the pressure chamber 125 decreases is applied to the piezoelectric actuator 130. The fourth voltage VP4 may be a pulse voltage, for example, −70 V. An absolute value of the fourth voltage VP4 is greater than an absolute value of the first waveform voltage VP1 and thus ink in the form of the droplet 129*a* may be ejected out of the nozzle 128.

A resonance waveform voltage (i.e., a first waveform voltage and a second waveform voltage) is applied such that ink contained in the nozzle 128 resonates and thus the droplet 129*a* is ejected by a small force, that is, a small piezoelectric voltage. Since the size of the ejected droplet 129*a* is proportional to a piezoelectric voltage, the small droplet 129*a* may be ejected by applying a low piezoelectric voltage. In this case, the ink 129 is ejected to sharply protrude at a central portion of the nozzle 128, the droplet 129*a* having a very small size compared to the size of the nozzle 128 may be ejected. Thus, when the droplet 129*a* is ejected based on resonance, the droplet 129*a* has a jet shape.

The ejected droplet 129*a* is accelerated in a direction toward the second electrostatic electrode 142 by the electrostatic force FE so as to be printed on the printing medium P. Since the ejected droplet 129*a* having a jet shape has a small radius of curvature compared with a spherical droplet having the same value as the ejected droplet 129*a*, a relatively high electrostatic driving force acts on the ejected droplet 129*a*. Even if the droplet 129*a* having a volume of 50 femtoliters or less is ejected, the droplet 129*a* may be less likely to scatter (or alternatively, be prevented from scattering) as a result of the electrostatic driving force. Thus, minute droplets may be ejected onto the printing medium P with high precision.

Figure 6:
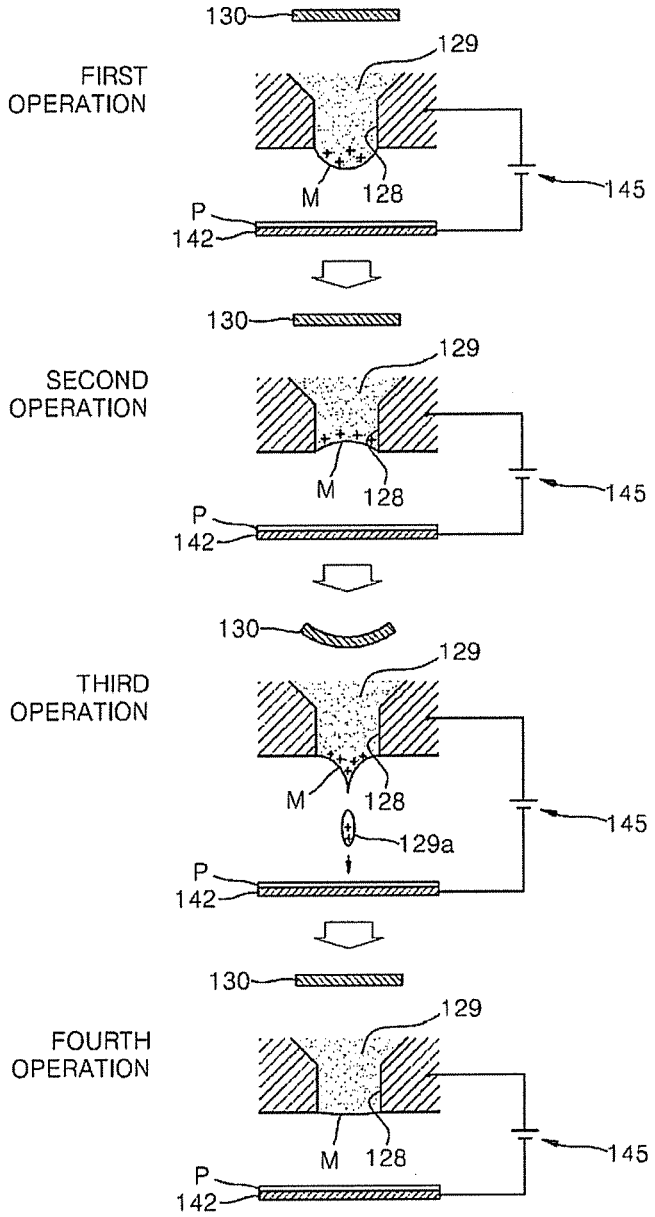
FIG. 6 is a set of diagrams for explaining a method of driving a hybrid inkjet printing apparatus, according to another example embodiment.
Figure 7:
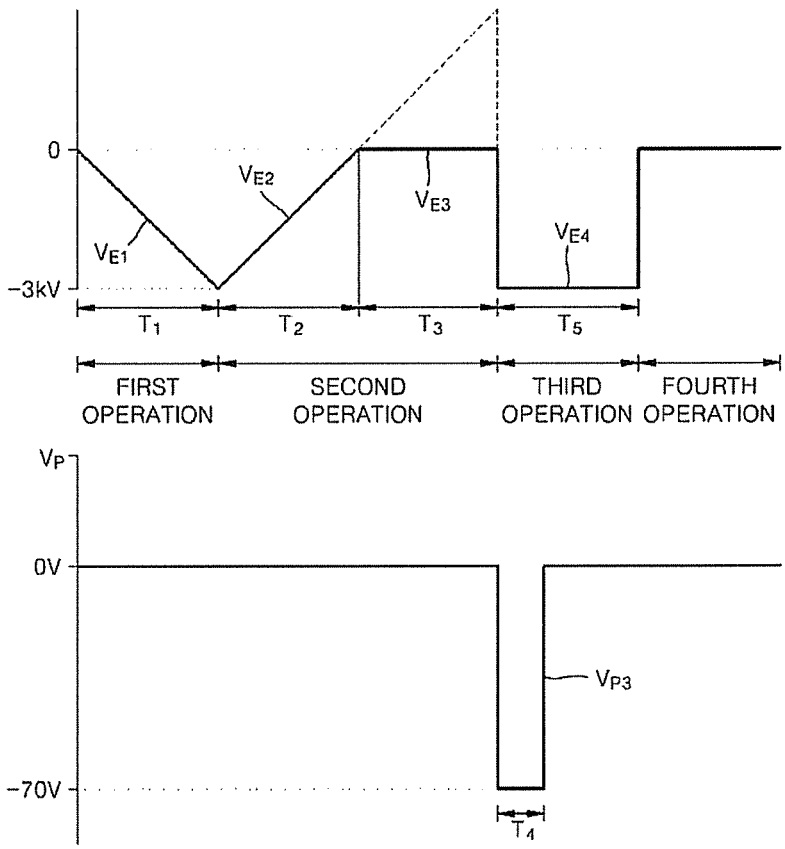
FIG. 7 is a timing diagram for explaining a method of driving a hybrid inkjet printing apparatus, according to another example embodiment.

FIG. 6 is a diagram for explaining a method of driving the hybrid inkjet printing apparatus 100, according to another example embodiment. FIG. 7 is a timing diagram for explaining a method of driving the hybrid inkjet printing apparatus 100, according to another example embodiment.

In a first operation, a voltage is not applied to the piezoelectric actuator 130 and a first waveform voltage VE1 is applied between the first electrostatic electrode 141 and the second electrostatic electrode 142 from the second power source 145. The first waveform voltage VE1 is applied for a time T1 that is 1/4 the resonance period of the meniscus M. The first waveform voltage VE1 varies from 0 V to about −3 kV. Positive charges and particles exhibiting positive charges may be moved to the meniscus M toward the second electrostatic electrode 142. The meniscus M is deformed to be convex toward a direction in which the ink 129 is ejected from the nozzle 128 by an electrostatic force that acts on the ink 129 contained in the nozzle 128.

The resonance period of the meniscus M may be determined by applying an electrostatic voltage to the electrostatic driving device and calculating the time between two peaks of the displacement of the meniscus M as stated above with FIG. 2.

In a second operation, a second waveform voltage VE2 is applied to the piezoelectric actuator 130 for a time that is 2/4 to 1 times the resonance period of the meniscus M. Referring to FIG. 7, the second operation is performed for a time T2 and a time T3. For the time T2, an electrostatic voltage varies from about −3 kV to 0 V. In this case, the meniscus M is moved in an opposite direction to a direction in which the ink 129 is ejected. A state in which a voltage is not applied to the piezoelectric actuator 130 is maintained.

Then, an electrostatic voltage VE3 may be maintained to 0 V for the time T3. A positive voltage is not applied for the time T3 such that positive charges are maintained in the meniscus M.

The time T2 may correspond to 1/4 the resonance period of the meniscus M. The time T3 may correspond to 1/4 to 3/4 the resonance period of the meniscus M. During the time T3, the meniscus M is in a resonance state by applying the first waveform voltage VE1 and the second waveform voltage VE2 and in a state to move in a direction in which the ink 129 is ejected.

In a third operation, the third voltage VP3 is applied to the piezoelectric actuator 130 in a direction in which the volume of the pressure chamber 125 decreases. A fourth voltage VE4 is applied between the first electrostatic electrode 141 and the second electrostatic electrode 142 from the second power source 145. The third voltage VP3 may be a pulse voltage, for example, −70 V. The fourth voltage VE4 may be, for example, −3 kV. The third voltage VP3 may be applied for the time T4. The fourth voltage VE4 may be applied for a time T5 that is longer than the time T4.

A resonance waveform voltage (i.e., a first waveform voltage and a second waveform voltage) is applied such that ink contained in the nozzle 128 resonates and thus the droplet 129*a* is ejected by a small force, that is, a small piezoelectric voltage. Since the size of the ejected droplet 129*a* is proportional to a piezoelectric voltage, the small droplet 129*a* may be ejected by applying a relatively low third voltage VP3. In this case, since the ink 129 is ejected to sharply protrude at a central portion of the nozzle 128, the droplet 129*a* having a very small size compared with the size of the nozzle 128 may be ejected. Thus, when the droplet 129*a* is ejected based on resonance, the droplet 129*a* has a jet shape.

The ejected droplet 129*a* is accelerated in a direction toward the second electrostatic electrode 142 by an electrostatic force so as to be printed on the printing medium P by applying the fourth voltage VE4. Since the ejected droplet 129*a* having a jet shape has a small radius of curvature compared with a spherical droplet having the same volume as the ejected droplet 129*a*, a relatively high electrostatic driving force acts on the ejected droplet 129*a*. Even if the droplet 129*a* having a volume of 50 femtoliters or less is ejected, the droplet 129*a* may be less likely to scatter (or alternatively, be prevented from scattering) as a result of the electrostatic driving force. Thus, minute droplets may be ejected onto the printing medium P with high precision.

In a fourth operation, when the fourth voltage VE4 is removed, the meniscus M having a convex shape returns to an original state.

As described above, in a driving method according to at least one example embodiment, ink droplets having a very small size compared with the size of a nozzle may be ejected. That is, minute droplets having a volume of 50 femtoliters or less may be ejected through a nozzle having a relatively great diameter, for example, a diameter of several μm to several tens of μm without reducing the size of a nozzle. In addition, even if a nozzle having a relatively great diameter is used, minute droplets may be ejected and thus the nozzle is not likely to clog, thereby increasing reliability of a printing apparatus. Further, minute droplets may reach a desired position of the printing medium using an electrostatic force.

It should be understood that the exemplary embodiments described herein should be considered in a descriptive sense only and not for purposes of limitation. Descriptions of features or aspects within each example embodiment should typically be considered as available for other similar features or aspects in other example embodiments.

What is claimed is:

1. A method of driving a hybrid inkjet printing apparatus, the method comprising:

applying an electrostatic voltage to ink contained in a nozzle;

applying a waveform piezoelectric voltage to a piezoelectric driving device in order to resonate the ink contained in the nozzle; and applying an ejection piezoelectric voltage to move the ink in the nozzle in a first direction in which the ink is ejected so as to eject the ink, wherein the applying of the waveform piezoelectric voltage to resonate the ink includes, applying a first waveform piezoelectric voltage to move and maintain the ink in the nozzle in the first direction, and applying a second waveform piezoelectric voltage to move the ink in a second direction opposite to the first direction, and wherein the ejection piezoelectric voltage is a pulse voltage having an absolute value greater than an absolute value of the waveform piezoelectric voltage.

2. The method of claim 1, wherein the applying of the electrostatic voltage is maintained during the applying of the waveform piezoelectric voltage and the applying of the ejection piezoelectric voltage.

3. The method of claim 1, wherein the applying of the waveform piezoelectric voltage comprises:

applying the first waveform piezoelectric voltage for a duration of about a quarter of a resonance period of a meniscus of the ink; and applying the second waveform piezoelectric voltage for a duration of about a half of the resonance period of the meniscus of the ink.

4. The method of claim 3, further comprising:

measuring the resonance period of the meniscus using the waveform piezoelectric voltage.

5. The method of claim 4, wherein the measuring of the resonance period of the meniscus comprises:

applying the waveform piezoelectric voltage to the piezoelectric driving device such that ink is not ejected;

measuring a displacement of the meniscus; and determining a time between two peaks of the displacement, the determined time being defined as the resonance period.

6. The method of claim 3, wherein the applying of the waveform piezoelectric voltage further comprises applying a third waveform piezoelectric voltage for moving the ink in the nozzle in the first direction in which the ink is ejected, the applying of the third waveform piezoelectric voltage is performed after the applying of the second waveform piezoelectric voltage and the applying of the ejection piezoelectric voltage is performed during the applying of the third waveform piezoelectric voltage.

7. The method of claim 1, wherein the ejecting of the ink comprises ejecting ink droplets having a smaller size than a size of the nozzle.

8. The method of claim 1, wherein the applying of the electrostatic voltage comprises applying the electrostatic voltage for a desired period of time after the ejection voltage is applied.

9. A method of driving a hybrid inkjet printing apparatus, the method comprising:

applying a waveform electrostatic voltage to ink contained in a nozzle to resonate the ink, the waveform electrostatic voltage being applied by an electrostatic driving device;

applying an ejection piezoelectric voltage to a piezoelectric driving device so as to eject the ink contained in the nozzle; and applying another electrostatic voltage to the electrostatic driving device during the applying of the ejection piezoelectric voltage, wherein the applying of the waveform electrostatic voltage includes, applying a first waveform electrostatic voltage for moving the ink in the nozzle in a first direction in which the ink is ejected, and applying a second waveform electrostatic voltage for moving the ink in a second direction opposite to the first direction.

10. The method of claim 9, wherein the waveform electrostatic voltage and the ejection piezoelectric voltage have the same polarity.

11. The method of claim 9, wherein the applying of the waveform electrostatic voltage comprises:

applying the first waveform electrostatic voltage for a duration of about a quarter of a resonance period of a meniscus of the ink; and applying the second waveform electrostatic voltage for a duration of about a half of the resonance period of the meniscus of the ink.

12. The method of claim 11, further comprising:

measuring the resonance period of the meniscus using the waveform electrostatic voltage.

13. The method of claim 12, wherein the measuring of the resonance period of the meniscus comprises:

applying the waveform electrostatic voltage such that ink is not ejected;

measuring a displacement of the meniscus; and determining a time between two peaks of the displacement as the resonance period.

14. The method of claim 11, wherein the applying of the waveform electrostatic voltage further comprises applying a third waveform electrostatic voltage for moving the ink in the nozzle in the first direction in which the ink is ejected, the applying of the third waveform electrostatic voltage is performed after the applying of the second waveform electrostatic voltage and the applying of the ejection piezoelectric voltage is performed during the applying of the third waveform electrostatic voltage.

15. The method of claim 9, wherein the ejecting of the ink comprises ejecting ink droplets having a smaller size than a size of the nozzle.

16. The method of claim 9, wherein the applying of the another electrostatic voltage comprises applying the electrostatic voltage for a desired period of time after the ejection piezoelectric voltage is applied.

* * * * *